US005269154A

United States Patent [19]

Schmidt

[11] Patent Number: 5,269,154

[45] Date of Patent: Dec. 14, 1993

[54] HEATED ICE DOOR FOR DISPENSER

[75] Inventor: Christopher G. Schmidt, Knight Township, Vanderburgh County, Ind.

[73] Assignee: Whirlpool Corporation, Benton Harbor, Mich.

[21] Appl. No.: 914,400

[22] Filed: Jul. 17, 1992

[51] Int. Cl.[5] ..... F25D 21/06

[52] U.S. Cl. ..... 62/275; 62/344; 62/389

[58] Field of Search ..... 62/272, 273, 275, 80, 62/377, 344, 389

[56] References Cited

U.S. PATENT DOCUMENTS

| | | | |
|---|---|---|---|
| 2,858,408 | 10/1958 | Barroero | 62/275 |
| 3,055,193 | 9/1962 | Smith | 62/272 |
| 3,224,216 | 12/1965 | Crouch | 62/275 |
| 3,680,329 | 8/1972 | Burtis | 62/275 |
| 3,813,896 | 6/1974 | Lebahn | 62/409 |
| 3,942,334 | 3/1976 | Pink | 62/344 |
| 3,968,660 | 7/1976 | Amann et al. | 62/275 |
| 4,102,660 | 7/1978 | Beckett et al. | 62/344 |
| 4,139,763 | 2/1979 | McMullan et al. | 219/528 |
| 4,142,092 | 2/1979 | Abrams | 219/218 |
| 4,548,049 | 10/1985 | Rajgopal | 62/275 |
| 4,555,049 | 11/1985 | Mawby et al. | 222/517 |
| 4,774,397 | 9/1988 | Grise | 219/549 |
| 5,029,737 | 7/1991 | Yamamoto | 222/526 |
| 5,050,777 | 9/1991 | Buchser | 222/146.6 |

*Primary Examiner*—Henry A. Bennet
*Assistant Examiner*—William C. Doerrler
*Attorney, Agent, or Firm*—Thomas J. Roth; Thomas E. Turcotte; Stephen D. Krefman

[57] ABSTRACT

A closure is shown for use with an ice dispensing apparatus having an ice chute operatively associated with a discharge opening. The closure includes a door case having a front wall of a size and shape corresponding to the opening and a rearwardly turned perimeter wall connected to the front wall and having an outwardly turned flange. An insulation core is disposed within the perimeter wall rearwardly of the front wall. A gasket engages the opening incident to the closure being in the closed position. A rear wall is provided for substantially covering the opening incident to the closure being in the closed position A resistance heater is positioned in the door case between the front wall and the insulation to prevent sweating of the closure.

11 Claims, 4 Drawing Sheets

HEATED ICE DOOR FOR DISPENSER

FIELD OF THE INVENTION

This invention relates to an ice dispensing apparatus and, more particularly, to an improved closure therefor.

BACKGROUND OF THE INVENTION

In one form of an ice making apparatus, an automatic apparatus is provided for forming ice bodies and periodically delivering the formed ice bodies into a subjacent container maintained within a freezer space of a refrigeration apparatus cabinet. In one conventional form, the ice bodies are removed from the container by a user grasping the ice bodies through an open top of the container and removing the desired quantity.

In another form of a refrigeration apparatus, a through-the-door ice dispenser is provided for automatically delivering a desired quantity of formed ice bodies from the container into a suitable receptacle, such as a glass or pitcher. Such an apparatus includes a conveying means for conveying ice bodies stored in the container to a discharge chute in the door. One example of such an automatic ice body dispenser is shown in Buchser U.S. patent application No. 549,651, filed Jan. 2, 1990, which is owned by the assignee of the present invention. As disclosed therein, the ice bodies are delivered from the container to a transfer mechanism by means of an auger which is rotated by a motor at the rear end of the auger. The forward end of the auger is connected to the transfer mechanism which transfers the ice bodies seriatim to the subjacent transfer chute leading to the dispensing area.

A typical conventional through-the-door ice dispenser includes a front opening in the ice chute through which ice pieces are delivered in a dispensing operation. The ice pieces may comprise the fully formed ice bodies, or crushed ice. Such an ice dispensing apparatus is shown in Buchser et al., U.S. patent application No. 522,901, which is owned by the assignee of the present invention, and which comprises a closure mounted frontwardly of the opening and being biased to a closed position wherein the closure effectively blocks the opening. An actuator is mounted adjacent the closure for moving the closure to an open position to permit free delivery of ice pieces through the opening as an incident of the actuator being moved from a released position to an actuated position.

Such a closure comprises an insulated well having an outer gasket for sealing engagement with the discharge chute. With such an ice dispensing apparatus, it is possible that external sweating, i.e., moisture or condensation, will appear in the ice dispenser area under high temperature or humidity conditions. This sweating results from the relatively low temperature inside the chute and the ambient conditions to which the exterior of the closure is exposed.

The present invention is directed to overcoming one or more of the problems as set forth above.

SUMMARY OF THE INVENTION

There is disclosed herein, in accordance with the present invention, an ice dispenser closure provided with a heater to prevent external condensation.

Broadly, there is disclosed herein an ice dispensing apparatus having an ice chute operatively associated with a discharge opening through which ice bodies are delivered in a dispensing operation. An improvement therein comprises a closure of a size larger than the discharge opening. Means are provided for mounting the closure frontwardly adjacent the opening and including means for moving the closure between an open position to permit free delivery of ice pieces through the opening and a closed position wherein the closure effectively blocks the opening A heating means is operatively associated with the closure for heating the closure to prevent sweating thereon.

It is a feature of the invention that a heater is provided internally to the closure.

It is another feature of the invention that the heating means is a resistance heater.

It is still another feature of the invention that the heating means is connected to an external power source, and including a flexible conductor extending between the closure and the source of power.

It is another feature of the invention that the closure includes a door case having a front well having an outwardly turned perimeter flange connected to a rear wall for engaging the opening, and the heating means is disposed between the front well and the rear wall.

There is disclosed herein in accordance with a further aspect of the invention an improvement in an ice dispensing apparatus having an ice chute comprising a generally tubular-like wall portion operatively associated with a discharge opening through which ice pieces are delivered in a dispensing operation. The improvement comprises an ice chute closure including a door case having a front well of a size and shape corresponding to the discharge opening, the well being connected to an outwardly turned perimeter flange. The flange supports a gasket. Means are provided for mounting the closure frontwardly of the opening and being biased to a closed position wherein the closure effectively blocks the opening with the gasket sealing against the wall portion and the baffles being disposed outwardly of the wall portion. An actuator is mounted adjacent the closure and includes means for moving the closure to an open position to permit free delivery of ice pieces through the opening as an incident of the actuator being moved from a released position to an actuated position. A heating means is operatively associated with the ice chute closure for heating said closure to prevent sweating thereon.

More specifically, there is disclosed herein a closure for use with an ice dispensing apparatus having an ice chute operatively associated with a discharge opening The closure includes a door case having a front wall of a size and shape corresponding to the discharge opening, a rearwardly turned perimeter wall connected to the front wall and having an outwardly turned flange. An insulation core is disposed within the perimeter wall rearwardly of the front wall. A gasket engages the opening incident to the closure being in the closed position. A rear wall is provided for substantially covering the chute opening incident to the closure being in the closed position. Means are provided for adhering the gasket and the rear wall in assembled relation with the flange. A resistance heater is enclosed in the door case to prevent external condensation on the closure.

Further features and advantages of the invention will readily be apparent from the specification and from the drawings.

DETAILED DESCRIPTION OF THE INVENTION

Figure 1:
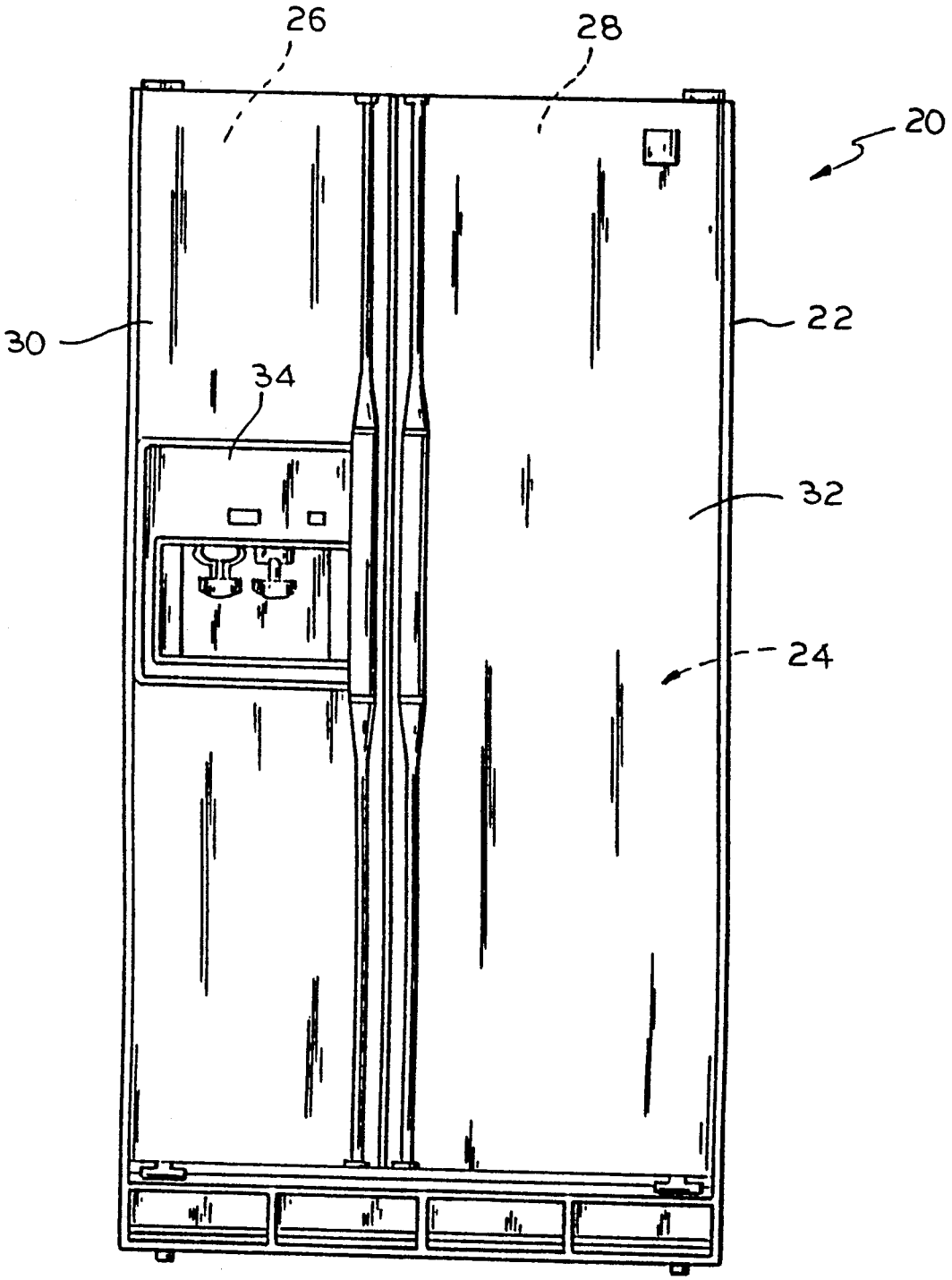
FIG. 1 is a front elevation view of a refrigeration apparatus including an ice dispenser closure according to the invention.

With reference to FIG. 1, a refrigeration apparatus 20, comprising a side-by-side refrigerator/freezer, includes a cabinet 22 having a storage space 24. Particularly, the storage space 24 comprises a below-freezing, or freezer, compartment 26, and an above-freezing, or fresh food, refrigerated compartment 28. Access to the compartments 26 and 28 is had through respective freezer and refrigerator doors 30 and 32 hingedly mounted to the cabinet 22, as is well known.

Figure 2:
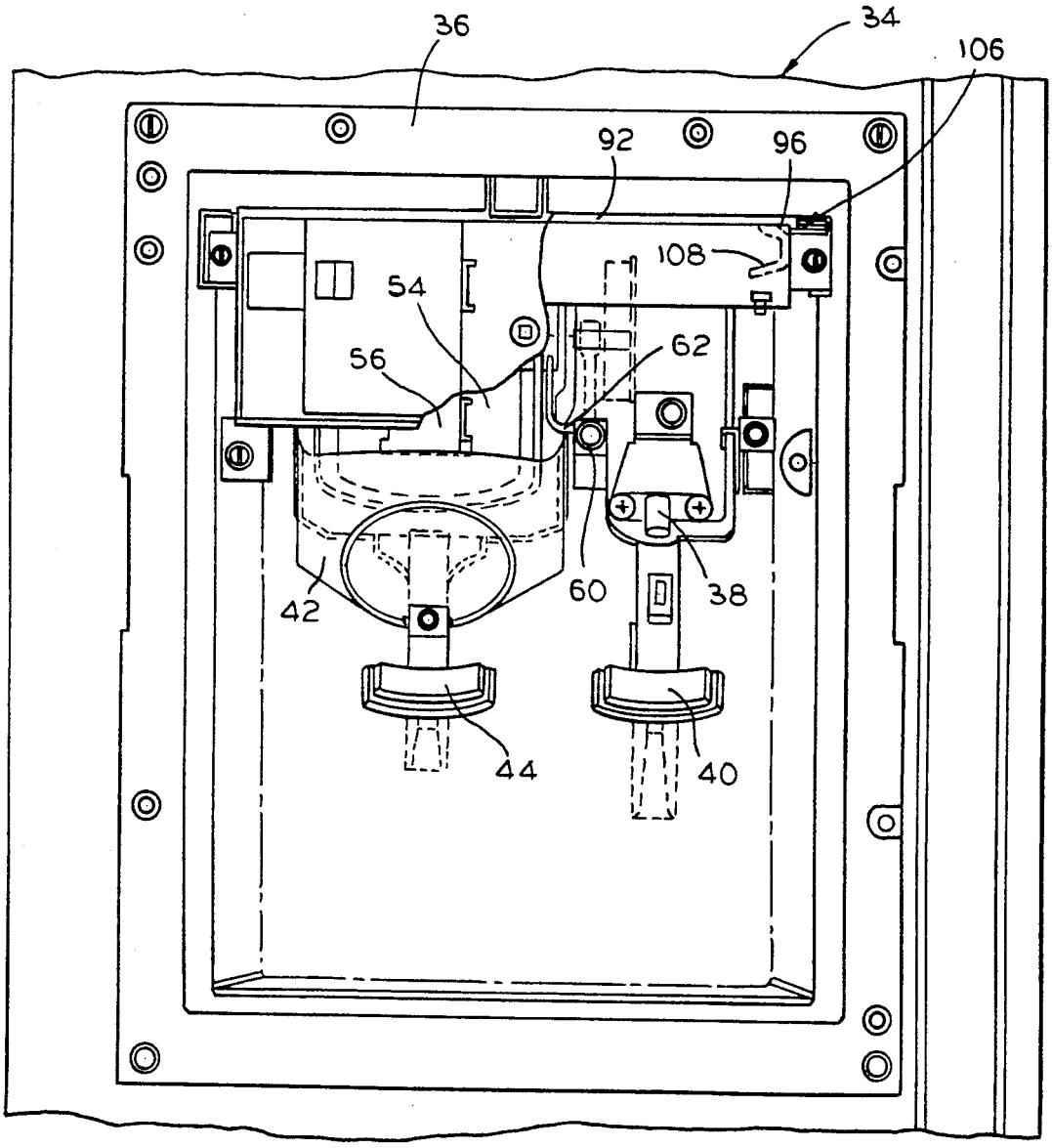
FIG. 2 is a front elevation, partially cutaway view of a through-the-door ice dispensing housing of FIG. 1 with a cover plate removed.

The freezer door 30 is provided with a through-the-door ice and water dispenser 34. The dispenser 34 is contained within a housing 36, see FIGS. 2 and 3, suitably mounted in the freezer door 30. The dispenser 34 includes a water spigot 38 through which water is automatically transferred to a receptacle position therebelow actuating a water dispenser lever 40, and an ice passage 42 through which ice pieces may be automatically transferred upon actuation of an ice dispenser lever 44. In the illustrated embodiment, the ice pieces may be fully formed ice bodies or crushed ice.

Figure 4:
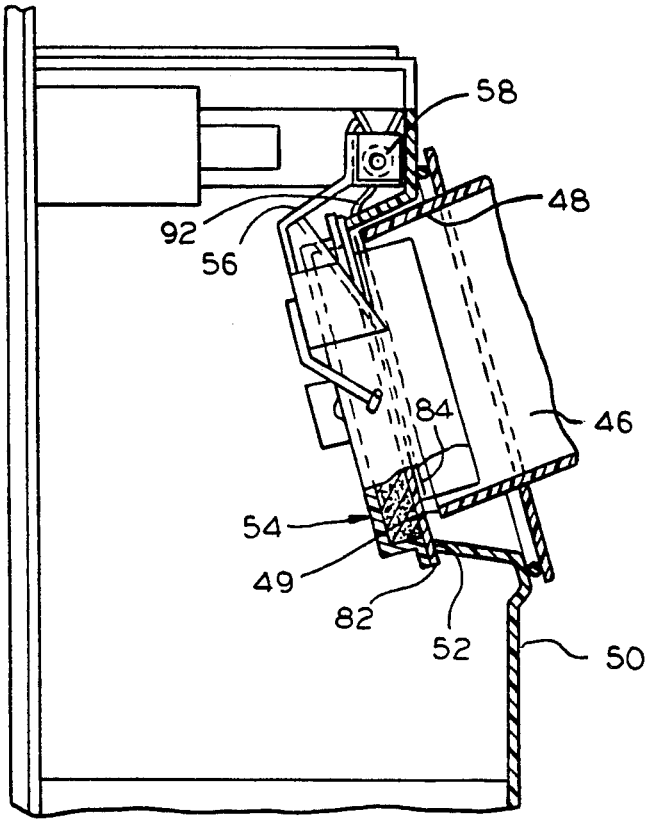
FIG. 4 is a partial sectional view, with parts removed for clarity, of FIG. 2 specifically illustrating a closure in the closed position.

Although not shown, the freezer compartment 26 houses a conventional ice making apparatus which delivers ice pieces to a downwardly, forwardly inclined delivery chute 46 in the door 30, see FIG. 4. Particularly, the chute 46 comprises a generally tubular-like wall portion 48 defining a front opening 49 which opens into a discharge opening 52 of a rear wall 50 of the dispenser housing 36 through which ice pieces are delivered in a dispensing operation. The discharge opening 52 is configured to be generally rectangular, except that the bottom edge thereof is curved to facilitate transfer of ice pieces, as is well known.

A closure 54 is mounted frontwardly of the opening 52. Specifically, a mounting structure 56 is pivotally mounted to the housing 36 as at a pivot link 58, and the mounting structure 56 biases the closure 54 to a closed position, illustrated in FIG. 4, effectively blocking the opening 52. As illustrated generally in FIG. 2, the ice dispenser lever 44 is mounted in the housing 36 adjacent the closure 54 and includes an actuator arm 60 for engaging a connecting rod 62 extending sidewardly from the mounting structure 56. As such, movement of the dispenser lever 44 from a released position to an actuated position causes the closure 54 to move to the open position, not shown, to permit free delivery of ice pieces through the opening 52.

The mounting structure 56 and its operation as disclosed herein are for illustration only. For a more complete understanding relative to the operation of the same, reference may be had to Marks U.S. Pat. No. 4,089,436, owned by the assignee hereof. In fact, the particular mounting structure and actuating mechanism may take many known forms and the embodiment disclosed herein is merely a illustrative of one such known form.

In accordance with the invention, the closure 54 prevents external condensation from collecting thereon.

Figure 5:
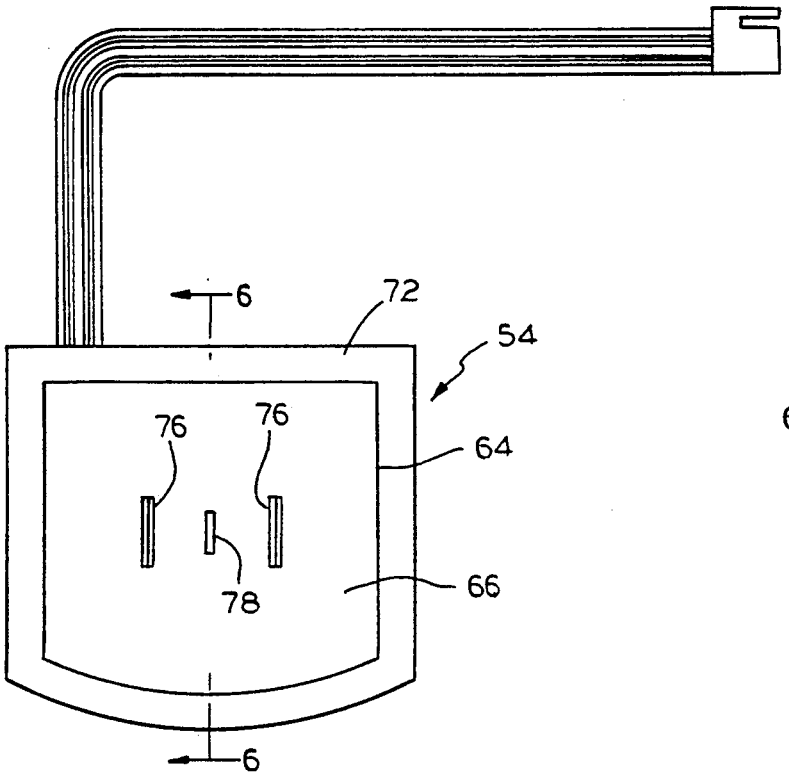
FIG. 5 is a front elevation view of the closure of FIG. 2.
Figure 6:
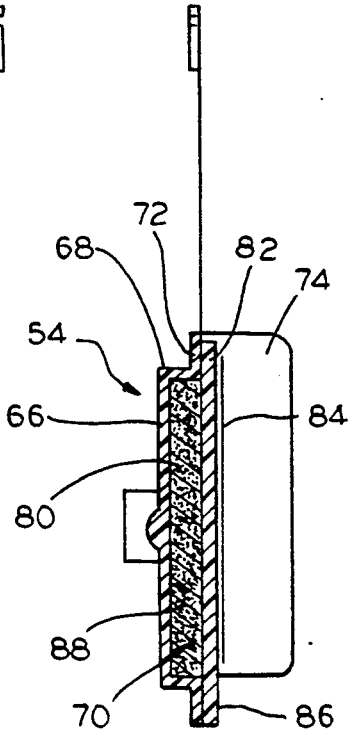
FIG. 6 is a sectional view taken along the line 6—6 of FIG. 5.

With reference to FIGS. 5 and 6, the closure 54 is illustrated in detail. The closure 54 includes a door case 64 having a front wall 66 of a size and shape corresponding to the discharge opening 52. A rearwardly turned perimeter wall is 68 is connected to the front wall 66 to provide a well 70. A perimeter flange 72 is connected to and extends outwardly from the perimeter wall 68. A pair of baffle walls 74, one of which is shown, are connected to and extend rearwardly from opposite sides of the flange 72. A pair of locking tabs 76 extend frontwardly from the front wall 66 and are used for mounting the closure 54 to the locking structure 56, as disclosed in FIG. 4. A protrusion 78, also on the front wall 66 between the locking tabs 76, rides on the locking structure 56 to allow for limited movement between the closure 54 and mounting structure 56 to insure a proper seal when the closure 54 is in the closed position.

In the illustrated embodiment, the door case 64 is of integral, molded construction, and may be of, for example, A.B.S flame retardant plastic In order to minimize heat transfer between the freezer compartment 26 and the outside, the well 70 is filled with a core 80 of insulation. The core 80 may comprise, for example, closed-cell polyethylene foam. The core 80 is flush mounted with the flange 72 and supports a foam pad 82. Particularly, the foam pad 82 is secured using a suitable adhesive to both the flange 72 and the core 80. The foam pad 82 may be, for example, closed-cell polyethylene foam. The pad 82 is slightly larger than the discharge opening 52 so that when the closure 54 is in the closed position, see FIG. 4, the outer edge of the pad 82 engages the same.

An impact shield 84 is secured to the rear surface of the pad 82. Particularly, the impact shield 84 may comprise, for example, a mylar polyester clear film. The shield 84 may be sealed using pressure sensitive adhesive to the pad 82. The impact shield 84 is of a size corresponding to that of the gasket pad 82, but is of a slightly smaller size so that a peripheral, outer edge gasket portion 86 of the pad 82 is exposed.

Thus, when the closure 54 is in a closed position, as illustrated in FIG. 4, the gasket outer edge portion 86 engages the outer edge of the housing 50 at the opening 52 to provide a seal and prevent flow of air between the freezer compartment and ambient. Further, the impact shield 84 minimizes the amount of ice which comes into direct contact with the pad 82 in order to prevent freeze up thereof which would diminish the sealing capability of the pad 82.

Figure 3:
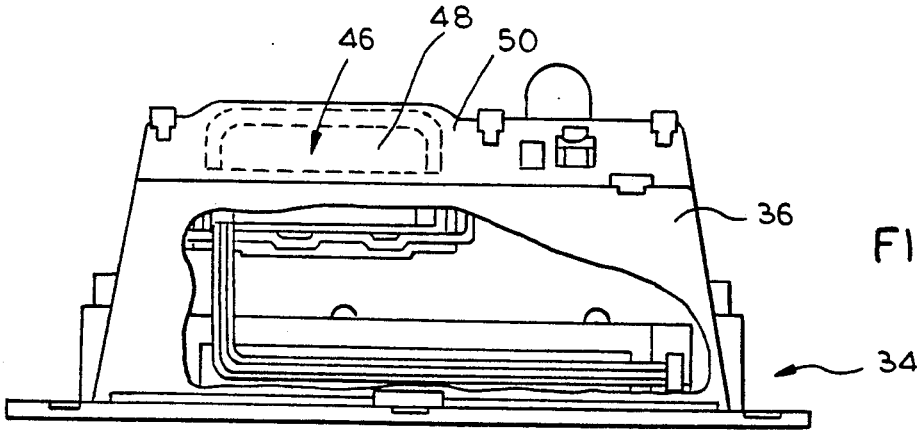
FIG. 3 is a top plan, partially cutaway view of the housing of FIG. 2.

When the closure 54 is in the closed position, see FIG. 3, the baffle walls 74 are disposed outwardly of the ice chute wall portion 48. When the closure 54 is moved to the open position, a free delivery of ice pieces is permitted through the opening 52. At the same time, the baffle walls 74 which are positioned on opposite sides of the chute wall portion 48 direct the flow of ice pieces delivered through the opening 52.

In order to prevent external condensation on the closure 54, a heater 88 is provided in the well 70 sandwiched between the front wall 66 and the insulation core 80.

Figure 7:
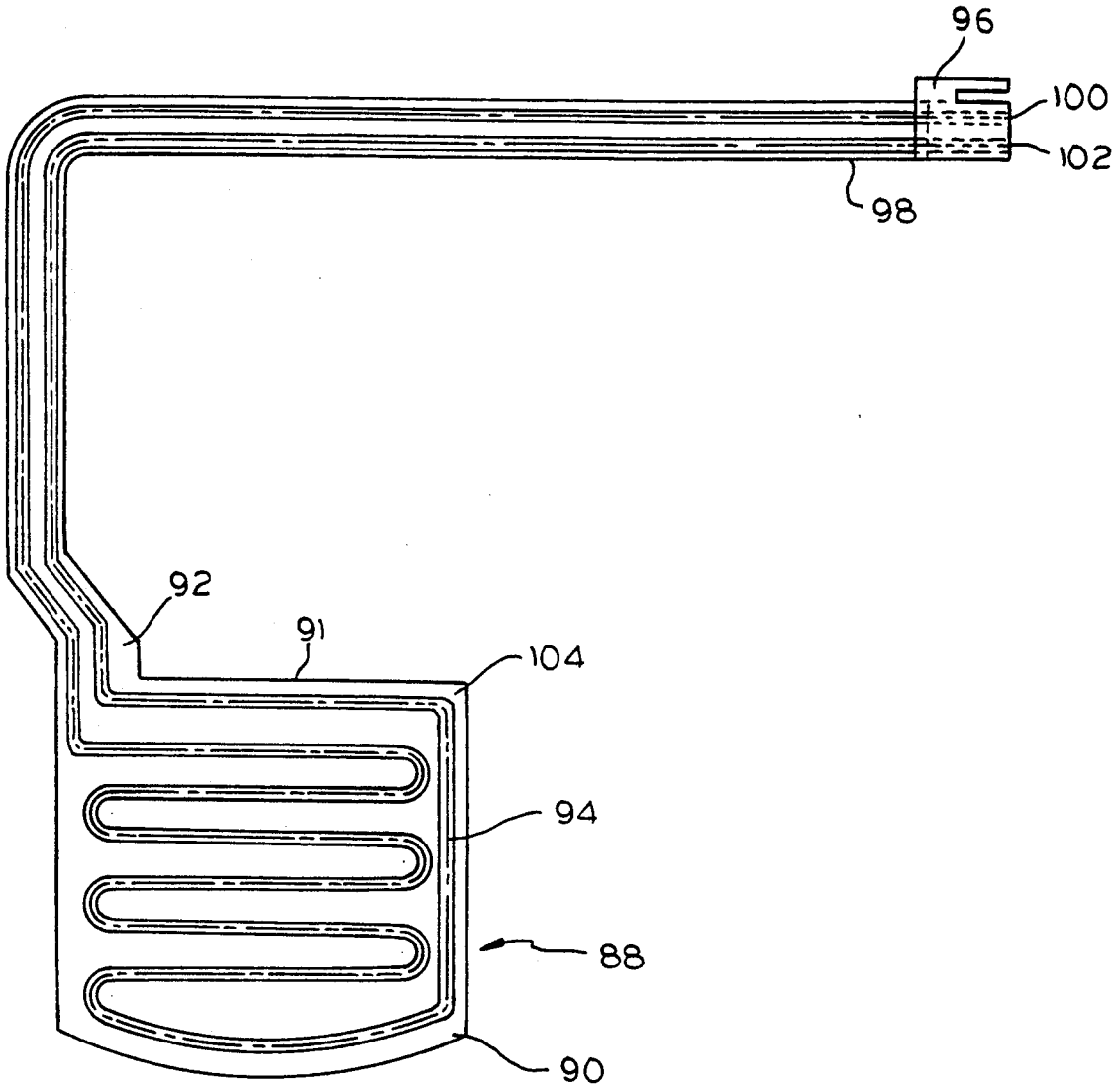
FIG. 7 is an elevation view of a resistance heater included in the closure of FIG. 5.

With reference to FIG. 7, the heater 88 is illustrated in detail. The heater 88 is of laminated construction and comprises a pair of laminated plastic sheets 90. The sheets 90 have a generally rectangular main portion 91, of a size and shape corresponding to the closure front wall 66, connected at an upper corner to an elongate, generally L-shaped extending portion 92. Silkscreened between the plastic sheets 90 is a track 94 of conductive, resistance ink traced thereon in a serpentine configuration. A silver blend of significantly lower resistance is screened on the trailing portion 92, or areas in which heat is not required A termination stabilizer 96 is secured to the trailer distal end 98 for connection of the opposite ends 100 and 102 of the track 94 to a power source.

An aluminum foil plate, indicated generally at 104, is provided on a back side of one of the plastic sheets 90. The foil layer 104 further distributes heat and isolates the heater 88 from the insulator core 80.

The plastic sheets 90 are flexible. When mounted in the closure, the connecting portion 92 extends upwardly therefrom, see FIG. 4, so as not to impede with opening and closing movement of the closure 54. The termination stabilizer 96 is then connected, as at 106, see FIG. 2, to suitable supply terminals 108 for powering the same. This provides for continuous energization of the heater trace resistance track 94.

The heater 88 mounted in the closure 54 has been found to considerably reduce external condensation with a relatively low wattage heater on the order of two watts.

Thus, there is disclosed herein, in accordance with the invention, a closure for use with an ice dispensing apparatus which includes a heater for preventing external condensation.

The disclosed embodiments of the invention are illustrative of the broad inventive concepts comprehended hereby.

I claim:

1. In an ice dispensing apparatus having an ice chute operatively associated with a discharge opening through which ice pieces are delivered in a dispensing operation, the improvement comprising:

a closure of a size larger than said discharge opening;

means for mounting said closure frontwardly adjacent said opening and including means for moving said closure between an open position to permit free delivery of ice pieces through said opening and a closed position wherein said closure effectively blocks said opening; and heating means operatively associated with said closure for heating said closure to prevent sweating thereon, said heating means comprises a laminated heater consisting of a pair of plastic sheets sandwiching a resistance heater element, said heater element comprises a track of conductive, resistance ink screened on said plastic sheets.

2. The improvement of claim 1 wherein said heating means is movable with said closure and said heating means further comprises a flexible connector for connection to a power source.

3. In an ice dispensing apparatus having an ice chute comprising a generally tubular-like wall portion operatively associated with a discharge opening through which ice pieces are delivered in a dispensing operation, the improvement comprising:

a closure including a door case having a front well of a size and shape corresponding to said discharge opening, said well being connected to an outwardly turned perimeter flange, said flange supporting a gasket;

heating means mounted in said door case for heating said closure to prevent sweating thereon; and means for mounting said closure frontwardly adjacent said opening and including means for moving said closure between an open position to permit free delivery of ice pieces through said opening and a closed position wherein said closure effectively blocks said opening, said heating means comprises a laminated heater consisting of a pair of plastic sheets sandwiching a resistance heater element, said heater element comprises a track of conductive, resistance ink screened on said plastic sheets.

4. In an ice dispensing apparatus having an ice chute comprising a generally tubular-like wall portion operatively associated with a discharge opening through which ice pieces are delivered in a dispensing operation, the improvement comprising:

a closure including a door case having a front well of a size and shape corresponding to said discharge opening, said well being connected to an outwardly turned perimeter flange, said flange supporting a gasket;

heating means mounted in said door case for heating said closure to prevent sweating thereon;

means for mounting said closure frontwardly adjacent said opening and including means for moving said closure between an open position to permit free delivery of ice pieces through said opening and a closed position wherein said closure effectively blocks said opening; and a core of insulation disposed in said well rearwardly of said heating means.

5. The improvement of claim 4 wherein said heating means comprises a foil layer on an outer surface in contact with said core of insulation.

6. A closure for use with an ice dispensing apparatus having an ice chute operatively associated with a discharge opening through which ice pieces are delivered in a dispensing operation, the closure being mounted frontwardly of the opening and being biased to a closed position wherein the closure effectively blocks the opening, and an actuator mounted adjacent the closure and including means for moving the closure to an open position to permit free delivery of ice pieces through the opening as an incident of the actuator being moved from a released position to an actuated position, the closure comprising:

a door case having a front wall of a size and shape corresponding to the discharge opening and a rearwardly turned perimeter wall connected to said front wall and having an outwardly turned flange;

heating means mounted in said door case for heating said closure to prevent sweating thereon;

an insulation core disposed within said perimeter wall rearwardly of said front wall;

a gasket for engaging the ice chute incident to the closure being in the closed position;

a rear wall for substantially covering said discharge opening incident to the closure being in the closed position; and means adhering said gasket and said rear wall in assembled relation with said flange.

7. The closure of claim 6 wherein said heating means comprises a resistance heater.

8. The closure of claim 6 wherein said heating means is movable with said closure and said heating means further comprises a flexible connector for connection to a power source.

9. The closure of claim 6 wherein said heating means comprises a laminated heater consisting of a pair of plastic sheets sandwiching a resistance heater element.

10. The closure of claim 9 wherein said heater element comprises a track of conductive, resistance ink screened on said plastic sheets.

11. The closure of claim 6 wherein said gasket comprises a pad having its outer edges secured to said flange and said rear wall comprises an impact shield secured to a rear surface of said pad wherein only a peripheral edge portion of said gasket is exposed.

* * * * *